US005127152A

United States Patent [19]

Meyer

[11] Patent Number: 5,127,152

[45] Date of Patent: Jul. 7, 1992

[54] WIRING TOOL HAVING WIRE COMBS

[75] Inventor: David L. Meyer, Jonestown, Pa.

[73] Assignee: AMP Incorporated, Harrisburg, Pa.

[21] Appl. No.: 675,581

[22] Filed: Mar. 26, 1991

[51] Int. Cl.[5] ..... H01R 43/04

[52] U.S. Cl. ..... 29/749; 29/753

[58] Field of Search ..... 29/749, 753, 566.3, 29/566.4, 751

[56] References Cited

U.S. PATENT DOCUMENTS

| | | | |
|---|---|---|---|
| 3,758,935 | 9/1973 | Long et al. | 29/749 X |
| 3,760,335 | 9/1973 | Roberts | 339/99 R |
| 3,800,390 | 4/1974 | Johnston | 29/749 |

OTHER PUBLICATIONS

Instruction Sheet 443J; AMP Incorporated; Apr. 28, 1989.

*Primary Examiner*—Carl E. Hall

*Attorney, Agent, or Firm*—David L. Smith

[57] ABSTRACT

An assembly for wiring a terminating tool (6) having wire combs (34,36) comprises a tool mount (164), a bench stand (166) and a clamp (168). The tool mount (164) has a clevis (178) for receiving one end of the tool (6) and a screw (187) for securing the tool (6) to the clevis (178). There depends from the clevis (178) a support leg (170) which is received between side walls (190) of the bench mount (166) which is mounted on the top surface of a work table (210). The clamp (168) has a clamp post (204) which is passed through notches (194) in the walls (190) of the bench mount (166) and through a hole (172) in the support leg (170), so that the tool mount and thus the tool (6) can be rocked about the axis of the clamp post (204). The clamp (168) has a clamp screw (200) which can be tightened against the underside of the work table (210) so that the clamp post (204) urges the bench mount (166) against the top side of the work table (210). The tool (6) can be rocked to one side of the vertical for wiring one of the combs (34,36) and to the other side of the vertical for wiring the other comb (34,36).

18 Claims, 9 Drawing Sheets

WIRING TOOL HAVING WIRE COMBS

FIELD OF THE INVENTION

This invention relates to a for an assembly and to an assembly, for use in bench mounting a tool comprising an elongate tool body and a pair of juxtaposed wiring combs connected to the tool body and extending longitudinally thereof, each comb defining a row of wire receiving slots which extend transversely of the length of the tool body.

BACKGROUND OF THE INVENTION

There is disclosed in U.S.-A-3,758,935 a free standing manual tool for mass terminating an electrical connector having wire receiving contacts projecting from opposite sides thereof. The tool comprises a first jig for holding the connector in a predetermined position and a second jig for locating the wires in predetermined positions. A wire inserting member is moved through and past the second holding jig and towards the first holding jig to transfer the wires from the second jig to the contacts of the connector. An edge of the wire inserting member acts as a shear edge for trimming the ends of the wires as they are being transferred from the second jig to the connector. One end of the second jig and one end of the wire inserting member are pivotally connected to the first jig. In order to allow for terminating wires to the contacts on both sides of the connector simultaneously, one end of a further second jig and one end of a further wire inserting member are pivotally attached to the first holding jig. In order to enable them to be wired, the second holding jigs are pivoted away from the first holding jig so that they extend obliquely with respect thereto on either side of the first holding jig.

SUMMARY OF THE INVENTION

As described below, a tool for mass terminating wires to wire receiving contacts projecting from opposite sides of an electrical connector, comprises a tool body having a fixed wire comb and a pivotal wire comb. The pivotal comb is pivoted away from the fixed comb, to allow the connector to be inserted between the combs and the pivotal wire comb is then pivoted towards the fixed wire comb so that the connector is enclosed between the wire combs. The two combs then extend in juxtaposed relationship lengthwise of the body. The present invention is intended to facilitate the wiring of the combs when the connector is enclosed therebetween as described above.

According to one aspect of the invention a kit of parts for an assembly for use in bench mounting a tool comprising an elongate tool body and a pair of juxtaposed wiring combs connected to the tool body and extending longitudinally thereof, each comb defining a row of wire receiving slots which extend transversely of the length of the tool body, comprises a tool mount, a bench stand and a clamp. The tool mount has a receptacle for one end of the body, means for securing the one end of the body in the receptacle and a support leg depending from the receptacle and defining first pivotal connection means for connecting the support leg to the clamp. The bench stand has a base for mounting on the top surface of a work table and is capable of receiving the support leg for limited pivotal movement about a horizontal axis. The clamp has second pivotal connection means, for connecting it to the support leg so that the support leg can pivot about the horizontal axis with respect to the clamp. The clamp has means, for example a clamping screw, for engaging the underside of the work table to clamp the bench stand against the top surface of the work table. For example, the first pivotal connection means may be a socket defined by the support leg of the tool mount, the second pivotal connection means being a clamp post projecting from the clamp for engagement in the socket and for engaging against the bench stand under the action of the clamping means of the clamp.

The kit of parts can thereby be assembled to the work table and the tool assembled to the receptacle of the tool mount, such that the tool can be pivoted about said horizontal axis, for example to the extend of 45° on either side of the vertical.

In the case of cross-row termination, where the wires are twisted pairs of wires, one wire of each pair is wired to one of the wire combs at a given location and the other wire of each pair is wired to the other comb in a corresponding location. In this case, the connector is rocked alternately from left to right and from right to left, one wire being inserted into a wire receiving slot in one comb in one angular position of the connector and another wire inserted into wire receiving slot of the other comb in the other angular position of the connector and so on. For in-row termination, where one comb is wired before the other, the connector is rocked into one of its angular positions and wires are inserted into all of the wire slots of one of the combs, the connector then being rocked to its angular position and wires inserted into all of the wire slots of the other comb.

According to another aspect of the invention, an assembly for use in bench mounting a tool comprising an elongate body and a pair of juxtaposed wiring combs connected to the tool body and extending longitudinally thereof, each comb defining a row of wire receiving slots which extend transversely of the length of the body, comprises a tool mount, a clamp body, and a bench stand. The tool mount has a receptacle for one end of the body, means for securing said one end of the body in the receptacle, a support leg depending from the receptacle, and defining a hole extending transversely of the support leg therethrough, at a position remote form the receptacle, and stop means on the tool mount. The clamp body has at one end, a clamp post extending through the hole in the support leg and clamping means at the other end of the clamp body. The bench stand has a base mounted on the top surface of a work table, opposite walls upstanding from the base and receiving the support leg between them. The walls have means therein for receiving the clamp post, and the clamping means of the clamp body engages the underside of the work table and thereby urges the bench stand against the top surface of the work table. The tool mount is rockable about the clamp post to an extent limited by the engagement of the stop means against the bench stand.

DETAILED DESCRIPTION OF THE INVENTION

Figure 1:
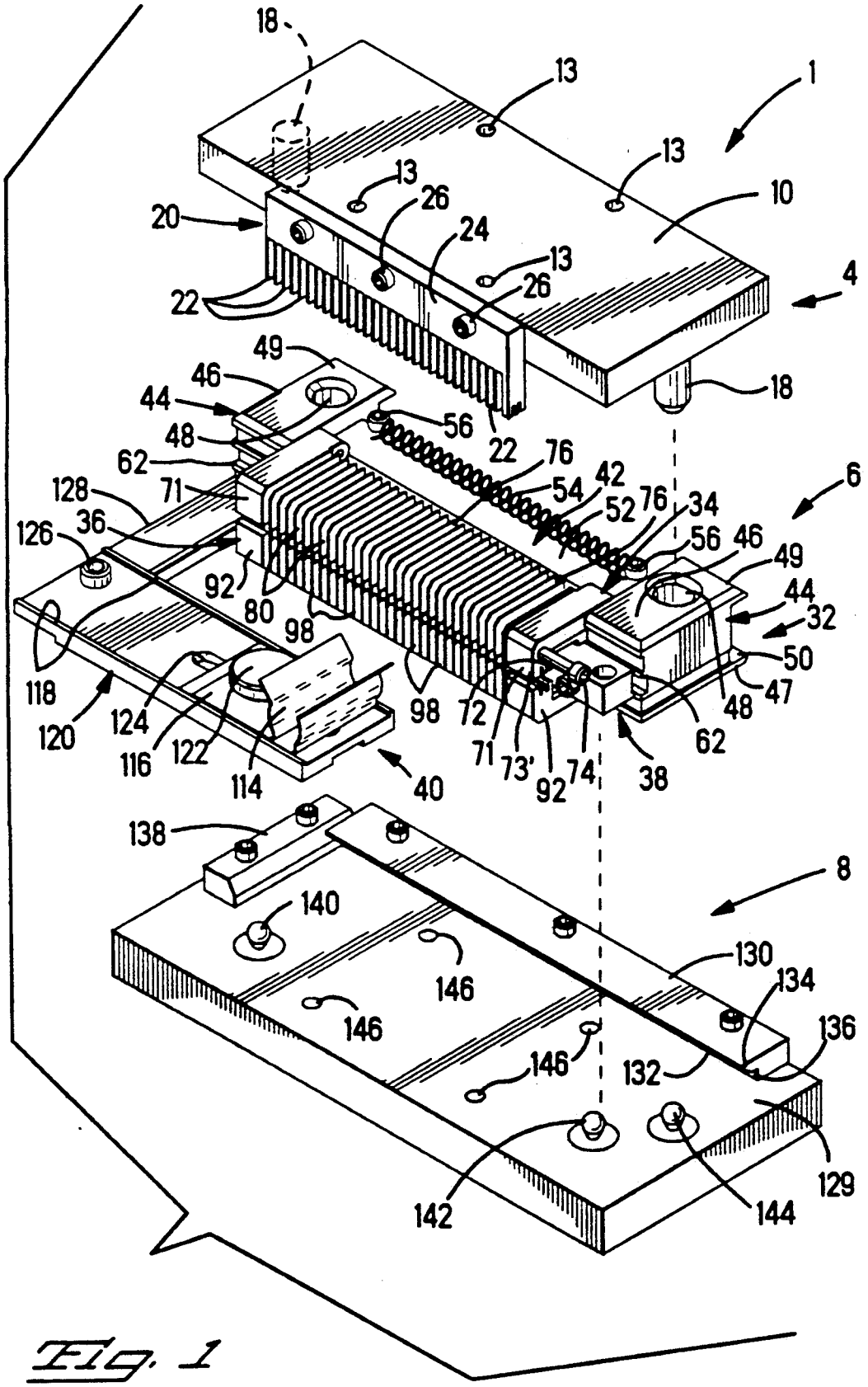
FIG. 1 is an exploded isometric view of tooling comprising upper and lower tooling assemblies and a base plate, for mass terminating insulated electrical wires to an electrical connector having insulation displacing slotted plate contacts.

As shown in FIG. 1, tooling 1 for terminating insulated wires of a multi wire electrical cable to an electrical connector 2 (FIGS. 4 and 5) according to U.S. Pat. No. 4,781,615 which is hereby incorporated herein by reference, comprises an upper tooling assembly 4, a lower tooling assembly 6, and a base plate 8. The parts of the tooling 1 are preferably made of steel.

Figure 2:
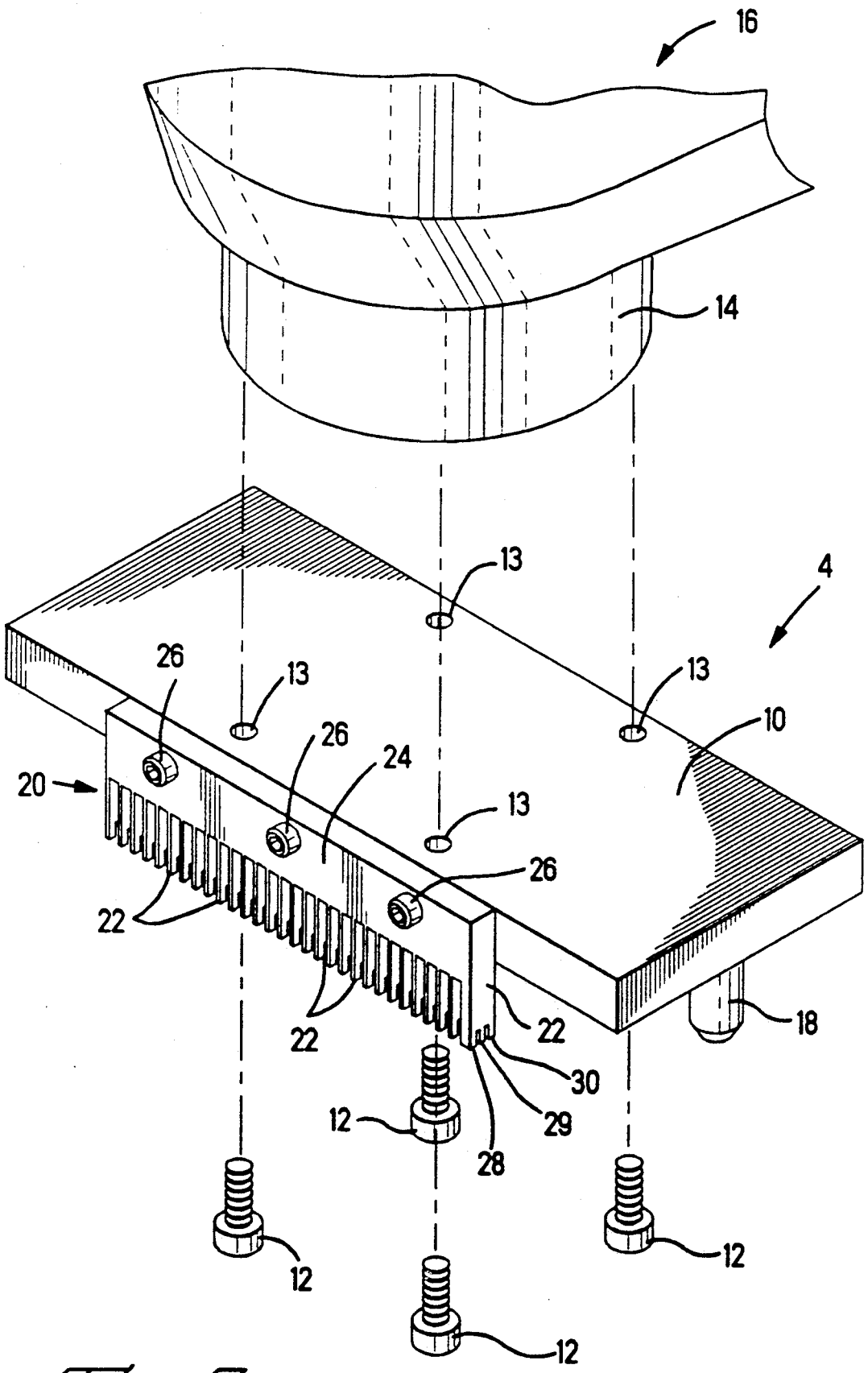
FIG. 2 is an enlarged, exploded isometric view illustrating the upper tooling assembly mounted to the ram of a press.
Figure 9:
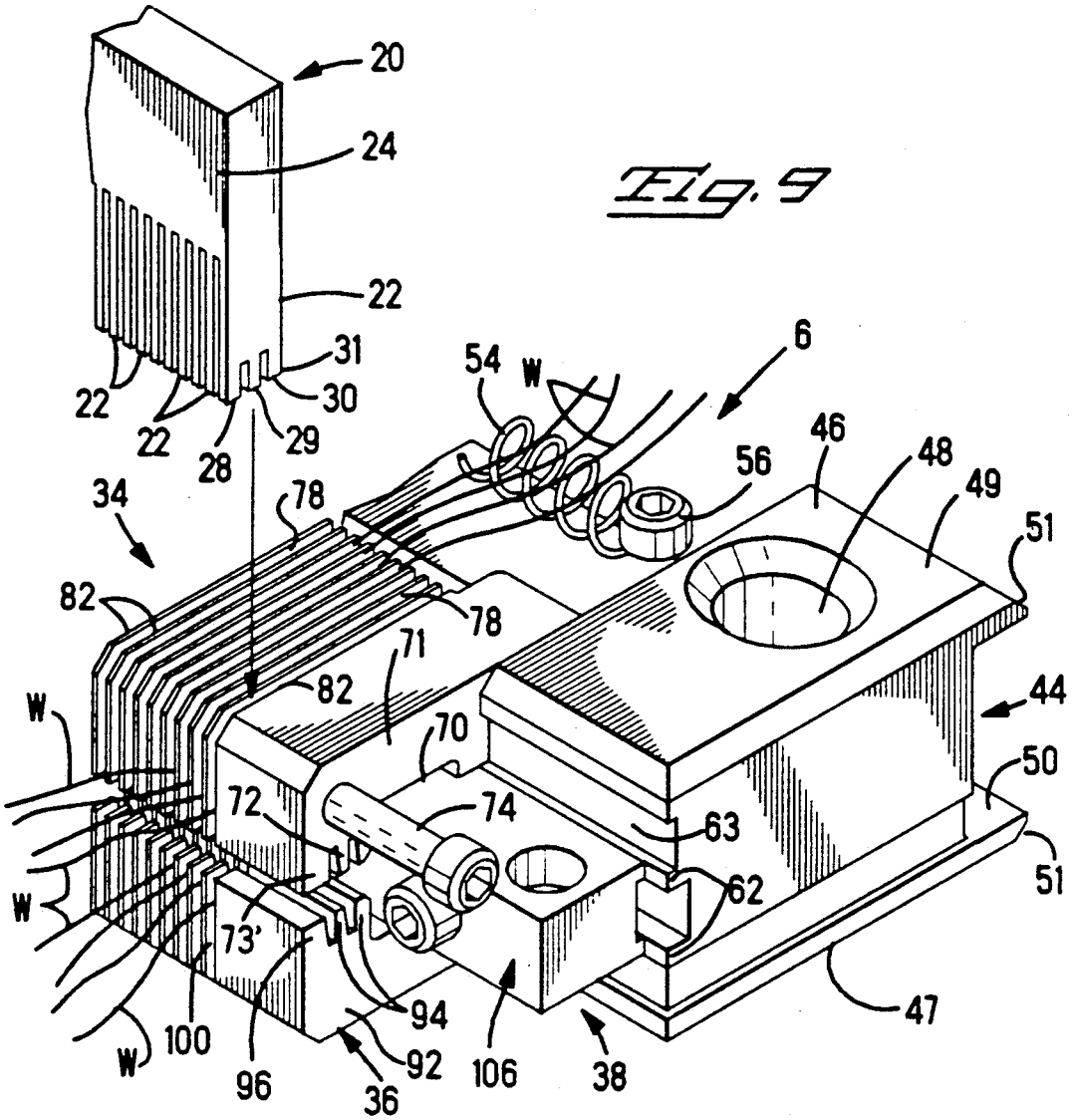
FIG. 9 is an enlarged fragmentary isometric exploded view showing the upper tooling assembly in use in terminating the wires to the connector in the lower tooling assembly.

The upper tooling assembly 4 comprises an elongate, rectangular, mounting plate 10, which as shown in FIG. 2, is arranged to be secured by means of cap screws 12 driven through holes 13 in the plate 10, to the ram 14 of an arbor press 16 which is not otherwise shown. There depends from each end of the plate 10, centrally of its width, a guide pin 18. A wire stuffer plate 20 has a row of wire stuffer and wire shear fingers 22 depending from a mounting bar 24 which is fixed to the forward edge of the plate 10 by means of screws 26. AS best seen in FIG. 9, each finger 22 is divided, proximate to its free end, so as to define three wire stuffer members 28, 29 and 30, respectively, spaced from each other in the direction of the thickness of the plate 20.

The lower tooling assembly 6 comprises an elongate tool body 32, a pivotable shear comb 34, a stationary connector supporting shear comb 36, a connector locator 38, and a cable clamp 40.

Figure 3:
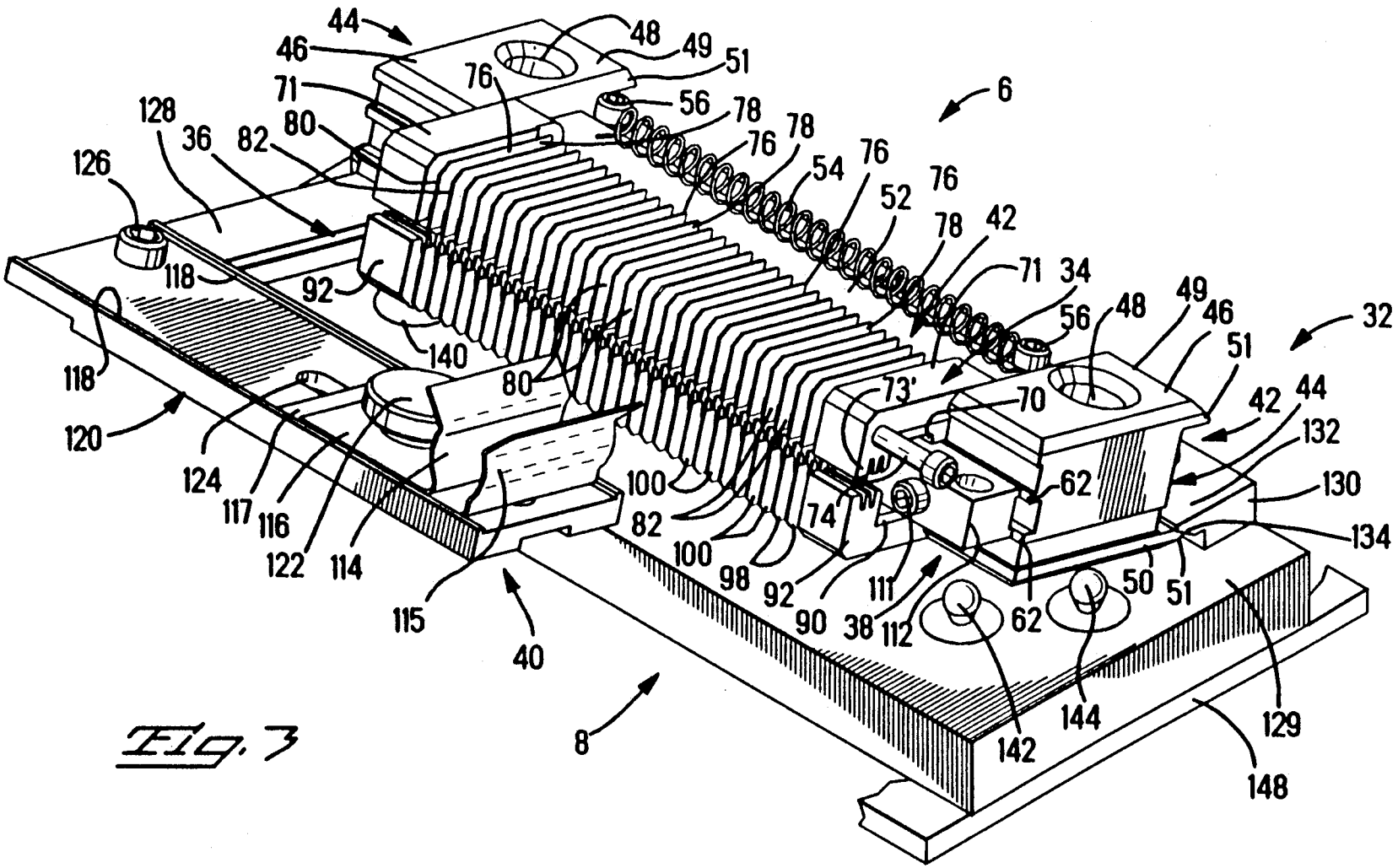
FIG. 3 is an enlarged isometric view showing the lower tooling assembly mounted to the base plate.
Figure 4:
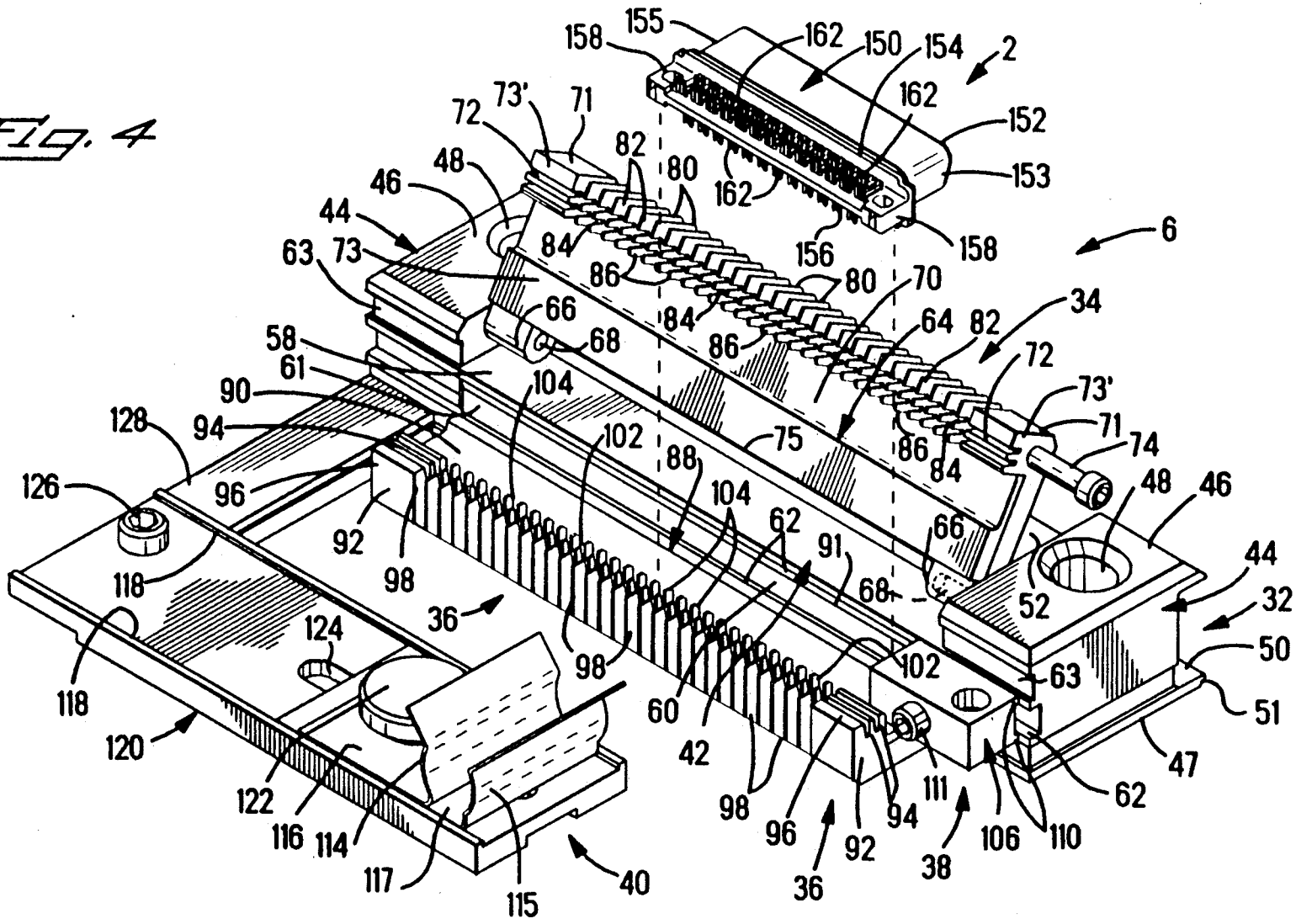
FIG. 4 is an enlarged isometric view showing the lower tooling assembly in an open position to receive the connector.
Figure 5:
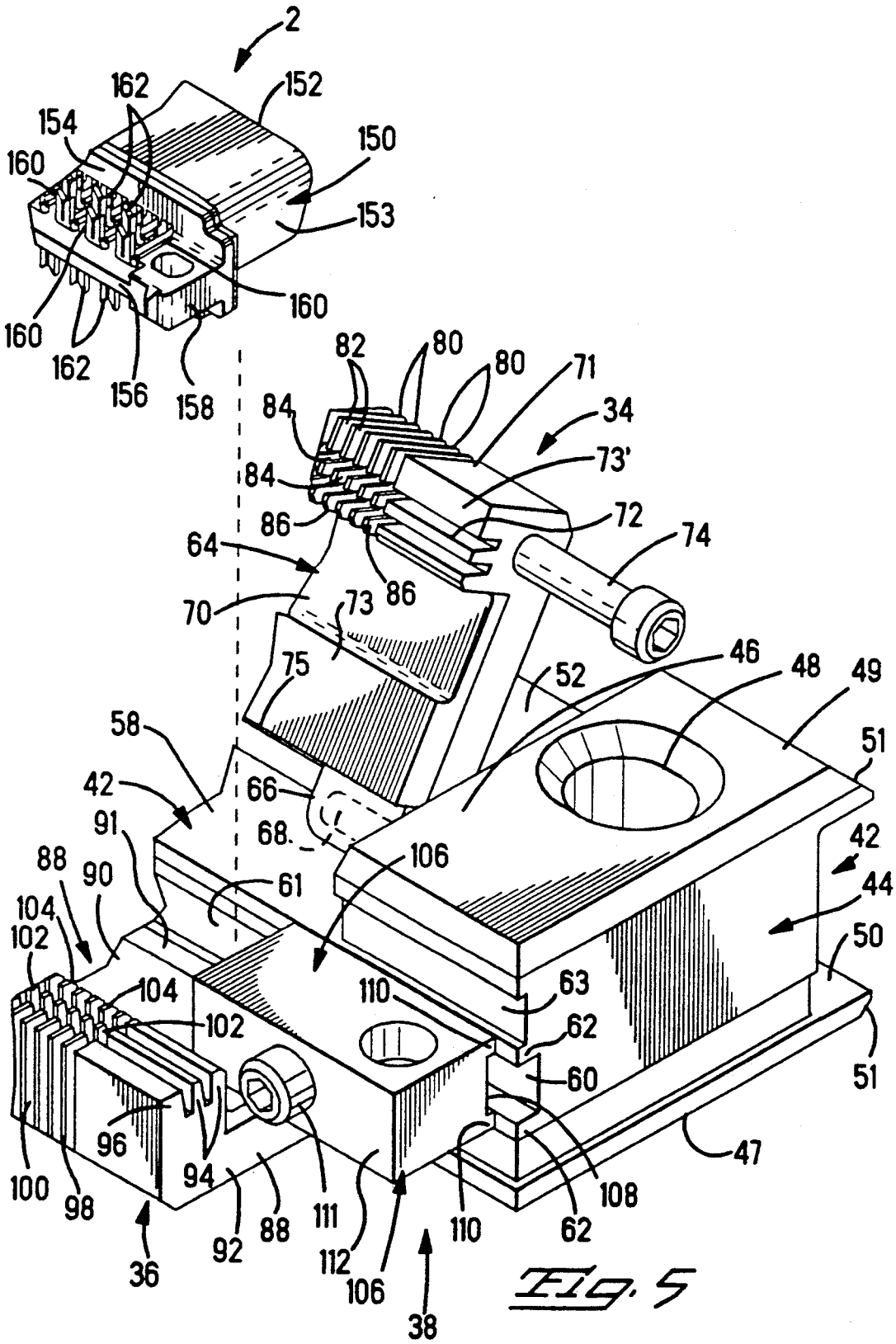
FIG. 5 is a further enlarged, fragmentary, isometric view illustrating details of FIG. 4.

As best seen in FIGS. 3-5, the body 32 comprises an elongate base 42 having at each end thereof a plinth 44 having a flat top surface 46 and a flat bottom surface 47 into each of which surfaces opens a circular cross section, through guide hole 48 for receiving a respective one of the guide pins. Lower tooling assembly locating flanges 49 and 50 project rearwardly from the top and the bottom, respectively, of each plinth 44, each flange 49 and 50 having a chamfered lead-in edge 51. On each side thereof, the base 42 has a flat surface 52 (only one of which is shown) extending between the plinths 44 and being positioned, in a vertical sense, between the surfaces 46 and 47 of the plinths 44. On each surface 52, there is supported, a wire retainer extension spring 54 (only one of which is shown), by means of a pair of screws 56 (only one pair of which is shown), each screw 56 being proximate to a respective plinth 44. Forwardly of, and coplanar with, the upper (as seen in FIGS. 4 and 5) surface 52, the base 42 has a flat forward surface 58 extending between the plinths 44, the base 42 having a front face 60 adjacent to the surface 58. A pair of parallel guide ribs 62 extend along the face 60 longitudinally thereof and along the front faces 63 of the plinths 44.

Figure 10:
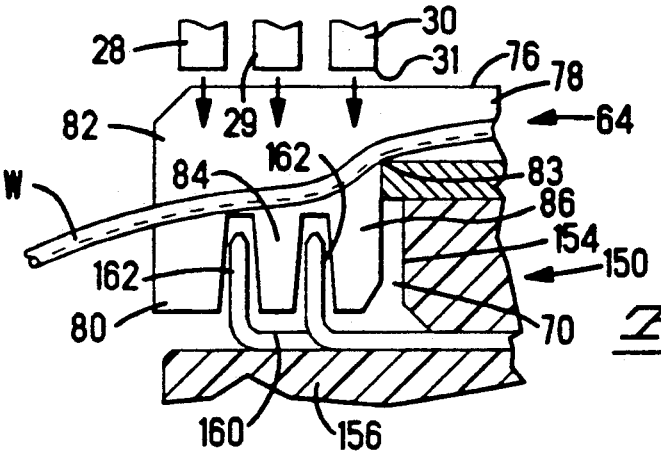
FIG. 10 is an enlarged fragmentary sectional view illustrating details of FIG. 9.

The pivotable shear comb 34 comprises an elongate mounting plate 64 having respective one of the plinths 44 above the surface 58. The comb 34 can be swung about the pins 68 between an open position (FIGS. 4 and 5) and a closed position (FIGS. 1, 3, 6 and 9). The underside of the plate 64 is formed with a connector receiving recess 70 extending over the full length of the plate 64. Rearwardly of the recess 70, the plate 64 has a flat surface 73 also extending over the full length of the plate 64, and standing proud of the recess 70. The rear edge 75 of the plate 74 is spaced above the surface 58. At each end of the forward end portion of the plate 64 is a block 71 from which project, normally of the plate 64, comb stop ribs 72' and 73'. The right hand (as seen in FIGS. 1, 3, 6 and 9) block 71 is provided with a handle 74 for use in opening and closing the comb 34. Between the blocks 71, the outer face of the plate 64 is formed with an array of parallel ribs 76 extending transversely of the length of the plate 64 and defining between them, wire receiving grooves 78. Portions 80 of the ribs 76 project from the forward margin of the plate 64 normally thereof. As best seen in FIGS. 5 and 10, there is aligned with each rib portion 80, in the transverse direction of the plate 64, two outwardly tapered spigots 84 and 86 spaced from each other transversely of the length of the plate 64. The forward margin of the plate 64 is formed with wire receiving parallel slots 82 extending therethrough as shown in FIG. 10 between the ribs 76. The plate 64 defines a shear edge 83 in each slot 82 at its junction with the respective groove 78 with which it merges.

The stationary shear comb 36 comprises a plate 88 projecting forwardly from the lower part of the front face 60 of the base 42 between the plinths 44. The upper surface of the plate 88 has a connector receiving recess 90 extending over the full length of the plate 88. The plate 88 has, between the front face 60 and the recess 90 a ledge 91 extending over the full length of the plate 88. At each end of the forward portion of the plate 88 is a block 92 from which projects normally of the plate 84 comb stop ribs 94 and 96 for co-operation with the comb stop ribs 72' and 73' respectively, of the pivotable comb 34. The lower surface of the plate 88 is formed with an array of parallel ribs (not shown) which are identical with, and are aligned with, the respective ribs 76 of the comb 34 and defined between them wire receiving grooves as do the ribs 76. Portions 98 of the ribs of the stationary comb 36 project from the forward margin of the upper surface of the plate 88 normally thereof. As best seen in FIG. 5, there is aligned with each rib portion 98, in the transverse direction of the plate 88, two outwardly tapered spigots 102 and 104 spaced from each other transversely of the length of the plate 88. The forward margin of the plate 88 is formed with wire receiving parallel slots 100 extending therethrough between the ribs of the plate 88, these slots being equivalent to the slots 82 of the plate 64, the plate 88 defining a shear edge (not shown) at its junction with the respective groove with which it merges. It will be apparent from the foregoing, that in the closed position of the comb 34, both sides of the combs 34 and 36 and the base 42 are of substantially identical appearance.

The connector locator 38 comprises a block 106 having on its rear face 108 spaced rails 110 each engaging against a respective rail 62 on the front face 60 of the base 42. There extends through the block 106, a locking screw 111 having at one end, a head projecting from the front face 112 of the block 106, the other end of the screw 111 engaging between the rails 62 to hold the rails 110 in engagement therewith. The locking screw 111 can be loosened to allow the rails 110 to slide along the rails 62, the block 106 being supported on the ledge 91 for sliding movement along the recess 90 in the plate 88.

The cable clamp 40 (FIGS. 1, 4 and 6) comprises a cable clamping clip provided by cable gripping spring plates 114 and 115 projecting from respective mounting plates 116 and 117 which are both slidable between rails 118 on an elongate support plate 120, in a direction parallel with the combs 34 and 36. The position of the spring plates 114 and 115 can be adjusted for cable gauge and connector position, by means of a thumb screw 112 extending through the plate 116. The screw 112 also extends through a slot 124 in the support plate 120 and a slot in the mounting plate 117, extending in the same direction as the slot 124. The other end of the support plate 120 is secured by means of a locking screw 126 to a cable clamp support arm 128 extending at right angles to the plate 120 and being secured to the left hand (as seen in FIGS. 1, 3 and 4) plinth 44. The locking screw 126 engages in a longitudinal slot (not shown) in the support arm 128 so that the support plate 120 can be adjusted longitudinally of the arm 128 by loosening the screw 126.

The base plate 8, which is elongate, flat and rectangular, has secured to its upper face 129, proximate to its rear longitudinal edge, a rear, lower tooling assembly locating bar 130, as best seen in FIG. 1, having a forward flange 132 overhanging the upper face 129, the flange 132 having a chamfered forward edge 134. The flange !32 defines in cooperation with the upper face 129, a recess 136 for receiving either of the flanges 49 or 50 of the plinth 44 of the lower tooling assembly 6. Proximate to the left hand (as seen in FIG. 1) end of the base plate 8, there is secured to the face 129, a side locating bar 138 for engagement by said left hand plinth 44. Also on the face 129, are resilient locating pins 140, 142 and 144 for snap engagement with the left hand (as seen in FIGS. 1, 3 and 4) end of the stationary comb 36 and the forward and lateral edges of the right hand plinth 44, respectively. The base plate 8 has through holes 146 for use in securing it to the arbor frame 146 (shown in fragmentary form in FIG. 3) of the press 16, by means of fasteners (not shown).

The connector 2, which is constructed according to the teaching of U.S. Pat. No. 4,781,615 as mentioned above, will now be described with reference to FIGS. 4 and 5. The connector 2, which in this example is a shielded plug connector, comprises a shielded elongate plug housing 150 having a forward mating face 152, a rear face 154 and side edges 153 and 155. A terminal support block 165 projects from the housing 150 rearwardly of the face 154 and is provided with a mounting lug 158 at each end. In the housing 150 are secured two superposed rows of electrical pin terminals each having a terminating portion 160 extending rearwardly across the support block 156 and having at its free end an insulation displacement, slotted plate contact 162 projecting normally of the block 156. The slotted plate contacts 162 of the terminals of the top row project from the upper side of the block 156 and the contacts 162 of the terminals of the bottom row project from the underside of the block 156. Adjacent terminating portions 160 of each row thereof are so relatively dimensioned that the slotted plate contacts 162 of the terminals of each row lie in two parallel rows.

A first mode of loading wires W into the lower tooling assembly 6, will now be described with particular reference to FIGS. 4, 5 and 6. The lower tooling assembly 6 is placed on a work bench (not shown) with the pivotable comb 34 uppermost. Firstly, the comb 34 is swung to its open position which is shown in FIGS. 4 and 5. The connector locator block 112 is then adjusted, for connector length, lengthwise of the rails 62, after loosening the screw 111. The screw 111 is then tightened. After such adjustment, the connector 2 is positioned in the stationary comb 36 with its side edge 153 against the block 106 and with the slotted plate contacts 162 of the terminals of the lower row extending between the rib portions 98, and the spigots 102 and 104 of the comb 36. More specifically, the contacts 162 of the forward row of contacts 162 projecting below the block 156, are each received between two adjacent spigots 102 and two adjacent spigots 104, the contacts 162 of the rear row being received between two adjacent spigots 102 and two adjacent rib portions 98. The wire receiving slot of each slotted plate contact 162 is thereby aligned with a respective slot 100 defined between the rib portions 98. If the contacts 162 are not so positioned, the locking screw 111 must be loosened and the connector locator block 112 repositioned so that the contacts 162 are correctly located in the comb 36, after which the screw 111 is tightened again. With the connector 2 correctly positioned in the comb 36, pressure is applied to the housing 150 of the connector 2 so that it snaps into place in the recess 90 of the comb 36.

Next, the cable clamp 38 is adjusted by loosening the locking screw 122 and moving the spring plates 114 and 115 along the support plate 120 so that they are opposite to the longitudinal center of the connector 2. If necessary, the spring plate 115 is adjusted relative to the spring plate 114, for cable gauge. In either case, the screw 122 is retightened.

The pivotable comb 34 is then swung to its closed position (FIG. 6) so that the contacts 102 projecting upwardly from the support block 156 of the connector 2 are received between the respective spigots 84 and 86 and rib portions 80, of the comb 34 with the wire receiving slots of the contacts 102 aligned with the slots 82, in a manner analogous with that described above with reference to the reception of the contacts 102 projecting downwardly from the block 156, between the spigots 102 and 104 and the rib portions 98 of the stationary comb 36.

Figure 6:
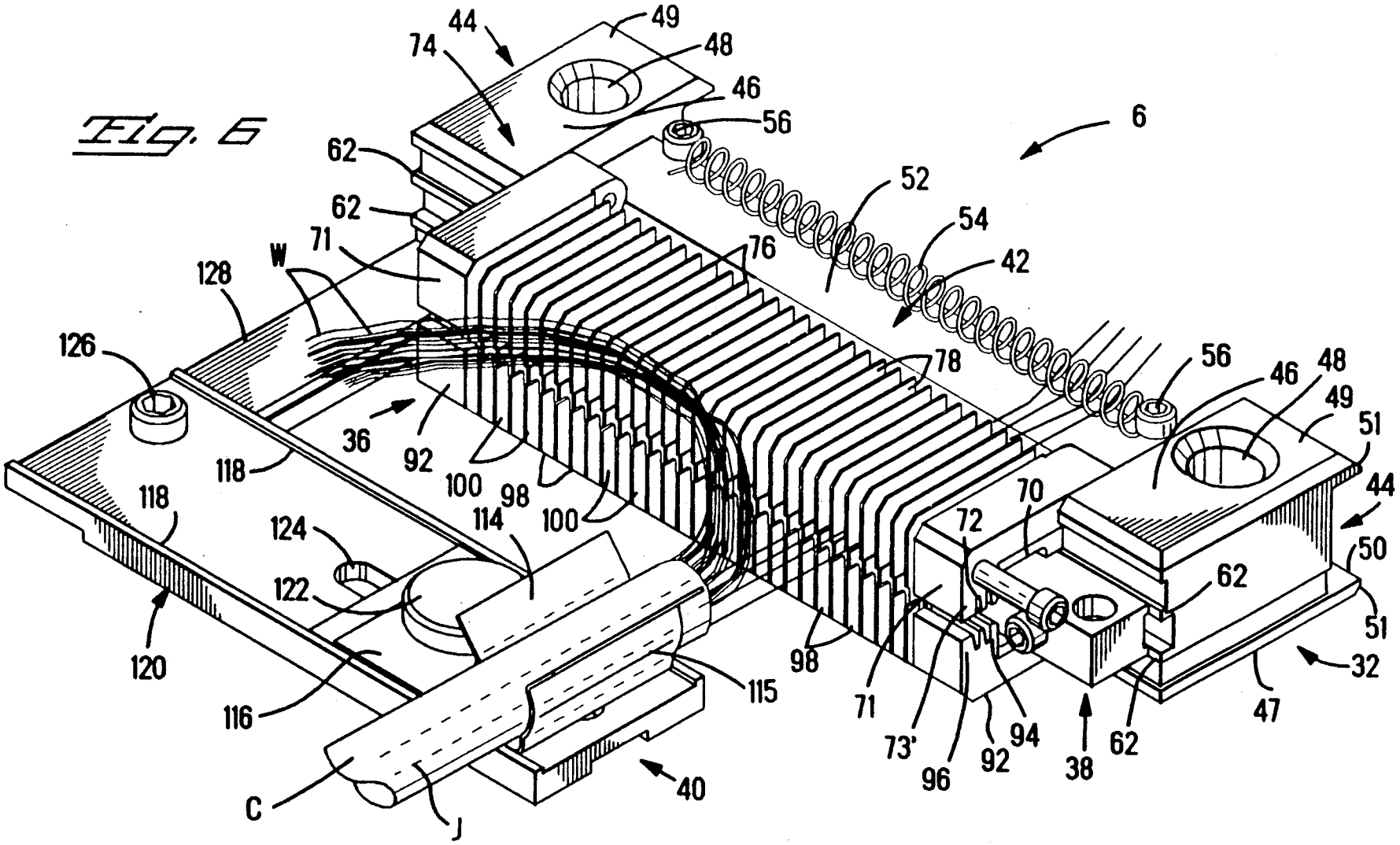
FIG. 6 is a similar view to that of FIG. 3 but illustrating one mode of loading the tooling assembly with wires, with the connector therein.

As shown in FIG. 6, the end portion of a multi wire electrical cable C, the jacket J of which has been stripped back to bare a substantial length of the insulated wires W of the cable C, is inserted into the cable clip between its spring plates 114 and 115. Selected wires W are then each threaded through a respective slot 82 above the respective contact 162 aligned therewith, through the respective groove 78 communicating with that slot 82 and between two respective adjacent coils of the extension spring 54 associated with the pivotable comb 34. The spring 54 thus holds the wires W in place during the wiring of the comb 34.

The lower tooling assembly 6 is then turned over so that the stationary comb 36 is uppermost and the comb 36 is wired with the remaining wires W in a manner analogous to that described above in respect of the wiring of the pivotable comb 34, the wires W being threaded through the slots 100 of the comb 36, through the grooves in the back thereof, communicating with the slots 100, and between the coils of the extension spring (not shown), associated with the comb 36.

A second mode of wiring the lower tooling assembly 6 will now be described with particular reference to FIGS. 7 and 8. Said second mode greatly facilitates the wiring operation especially in the case of cross-row termination, where the wires are twisted pairs, one wire of each pair being wired to the comb 34 at a given location and the other wire of each pair being wired to the comb 36 at a corresponding location. Said second mode also facilitates in-row termination, where one comb is wired before the other.

Figure 7:
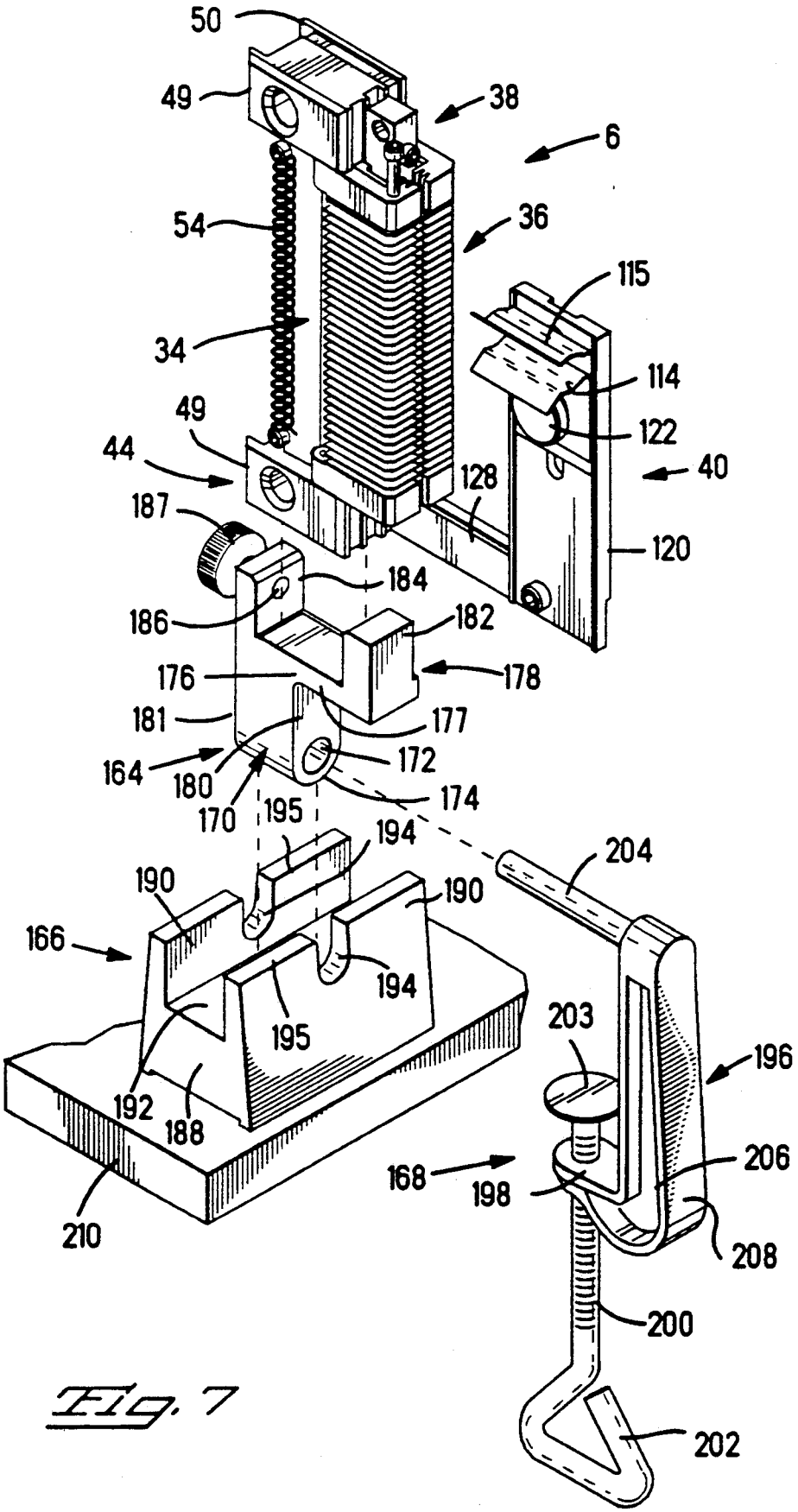
FIG. 7 is an exploded isometric view of a bench mounting assembly for use in another mode of loading the tooling assembly with wires.
Figure 8:
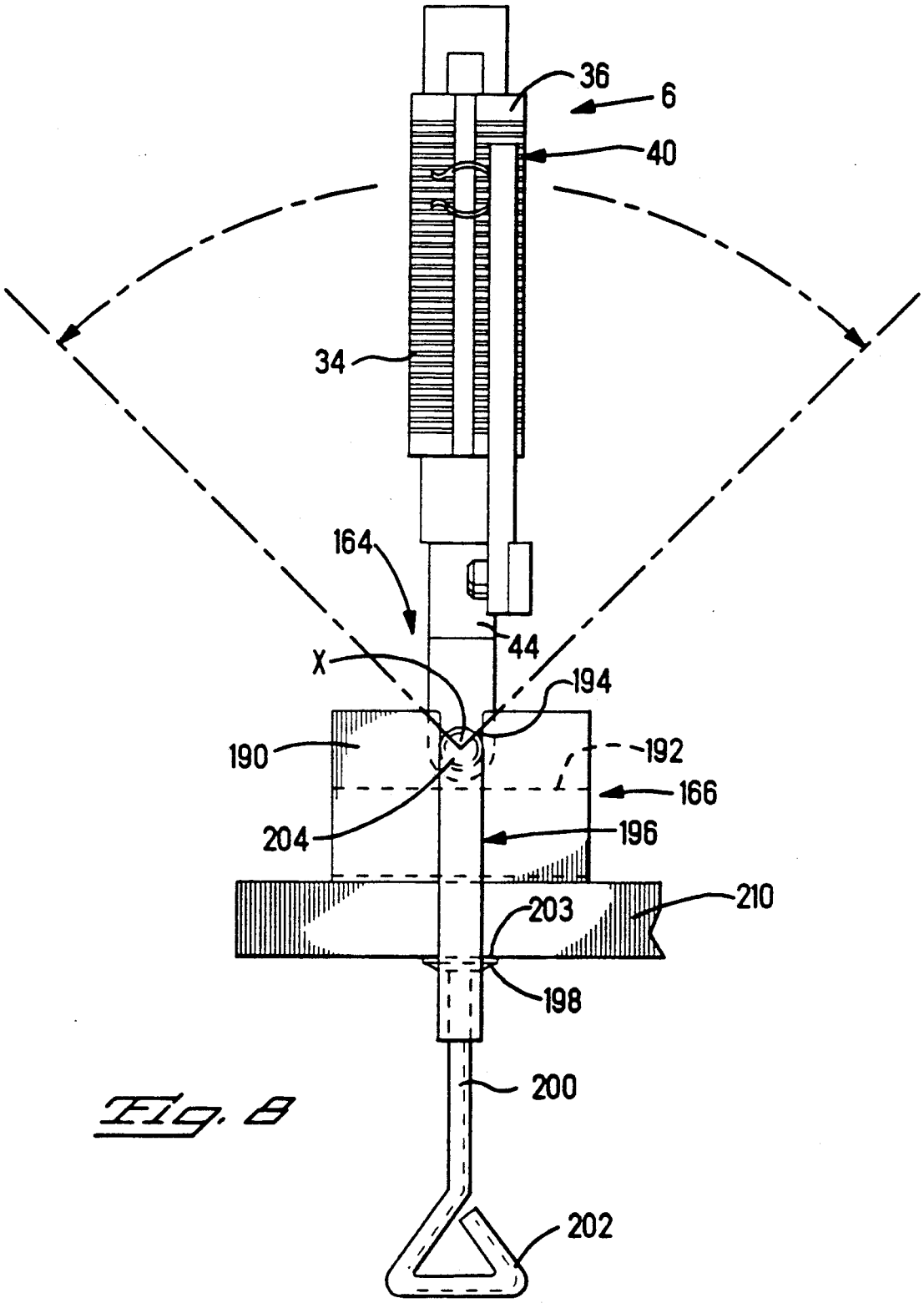
FIG. 8 is an elevational view illustrating the operation of the bench mounting assembly.

As shown in FIG. 7, an assembly for bench mounting the lower tooling assembly 6 comprises a tool mount 164, a bench stand 166 and a clamp 168. The tool mount 164 comprises a support leg 170 having a hole 172 therethrough opening into opposite flat lateral faces 180 and 181 of the leg 170, the leg 170 having a rounded free end portion 174. The leg 170 is surmounted by a flat, elongate, base 176 of a clevis 178. A portion 177 of the base 176 projects beyond the face 180. The clevis 178 comprises two substantially rectangular arms 182 and 184, respectively, upstanding from opposite ends of the base 176. A thumb screw 186 having a head 187 on the far side of the arm 184 is threaded into a tapped through opening in the arm 184. The bench stand 166 comprises an elongate base 188 from opposite longitudinal edges of which upstand a pair of side walls 190 defining a channel 192, each side wall 190 having a rounded notch 194 opening into its free longitudinal edge 195 centrally thereof, the notches 194 being aligned with each other. The clamp 168 comprises an elongate body 196 having a flange 198 projecting transversely therefrom proximate to its upper end, the flange 198 having a through tapped opening threadedly receiving a clamping screw 200 having a handle 202, and a flat head 203. There projects from the upper end of the body 196 transversely thereof and parallel with the flange 198, a rectilinear clamp post 204. Between the post 204 and the flange 198 the body 196 is formed with a longitudinally extending, through opening 206, one wall 208 of which, opposite to the clamp 198 is bowed therebelow, so that the flange 198 is moveable resiliently away from the post 204.

In use of the bench mounting assembly just described, the bench stand 166 is placed on a work table 210 with the base 188 proximate to an edge of the table 210, as shown in FIG. 7. The leg 170 of the tool mount 164 is then inserted into the channel 192 of the stand 166 with the hole 172 of the leg 170 in line with the notches 194 and with the head 187 of the thumb screw 186 facing away from the said edge of the work table 210 and thus away from the operator. The clamp post 204 of the clamp 196 is now inserted through the holes 172 and the notches 194 and the clamping screw 200 is tightened by means of the handle 202 so that the head 203 bears resiliently against the underside of the table 210. The tool mount 164 is thus secured in the stand 166, for pivotal movement about the clamp post 204. The lower tooling assembly 6 is then placed in the tool mount 164 with the arm 128 facing downwards, so that the arm 184 of the tool mount 164 is received between the flanges 49 and 50 of the lower most plinth 44 whereby that plinth is seated in the clevis 178. The thumb screw 186 is then tightened to secure the assembly 6 in the tool mount 164. As indicated in FIG. 8 the tool mount 164 and thus the assembly 6 can be rocked about a horizontal axis X through an angle of some 45° on each side of the vertical, to an extent limited by the abutment of the portion 177 of the base 176 against a respective edge 195 of the stand 166.

With the connector 2 located in the assembly 6 in the manner described above with reference to FIGS. 4 and 5, the assembly 6 can be rocked alternately from left to right to facilitate lacing the wires W into the combs 34 and 36 alternatively, in cross-row termination. For in-row termination, the assembly may be rocked to one side to lace the wires into one of the combs and to the other side to lace wires into the other comb.

The manner in which the wires W are terminated to the terminals of the connector 2 will now be described with particular reference to FIGS. 1 to 3, 9 and 10. With the upper tooling assembly 4 mounted to the press ram 14 as described above with reference to FIG. 2 and the base plate 8 mounted to the arbor frame 148 as described above with reference to FIG. 1, the wired assembly 6 with the connector therein is mounted to the base plate 8, by inserting the flanges 50 of the plinths 44 under the flange 132 of the rear locating bar 130, as shown in FIG. 3, guided by the chamfered edges 51 of the flanges 50 and the chamfered edge 134 of the flange 132, the side of the plinth 44 proximate thereto abutting the side locating bar 138. The assembly 6 is then pressed down so that the other plinth 44 snaps into engagement with the pins 142 and 144 and the end of the comb 36 remote therefrom snaps into engagement with pin 140, whereby the assembly 6 is secured to the base plate 8.

The press ram 14 is driven down through a working stroke so that the guide pins 18 on the plate 10 enter the guide holes 48 in the plinths 44 so that the lower tooling assembly 6 is precisely located with respect to the stuffer plate 20, whereby each finger 22 enters a respective slot 82 of the comb 34, as indicated in FIGS. 9 and 10. During the working stroke of the ram 14, the shear edge 31 of each stuffer member 30 shears a respective wire W at a position proximate to the rear face 154 of the connector housing 150 in cooperation with the respective shear edge 83 of the comb 34, each of the rearward contacts 162 of the terminals of the top row is then received between the stuffer members 28 and 29 of a respective finger 22 of the plate 20, each of the forward contacts 162 of the terminals of the top now being received between the stuffer members 29 and 30 of a respective finger 22. As the ram 14 bottoms, the stuffer members 29 to 30 stuff the respective severed end portions of the wires W into the wire receiving slots of the respective contacts 162. The scrap parts of the wires W retained in the spring 54 are then removed. The stop ribs 72, 73', 94 and 96 of the blocks 71 and 92 cooperate to prevent damage to the combs should the ram 14 overtravel, although its working stroke should previously have been adjusted so as to be of the correct length.

The ram 14 is then driven through a return stroke and the lower tooling assembly 6 is removed from the base plate 8 and is turned over so that the comb 36 is uppermost. The flanges 49 of the plinths 44 are inserted under the flange 132 of the locating bar 130 and the assembly 6 is secured to the base plate in the manner described above. The ram 14 is then again driven through a working stroke so that the fingers 22 enter the respective slots 100 of the comb 36 to sever the wires W extending therethrough and to stuff their severed end portions into the wire receiving slots of the contacts 162 of the upper row of terminals of the connector 2. The scrap wire parts are removed, the pivotable comb 34 is opened, and the fully wired connector 2 is removed from the assembly 6. A screw driver may be used for this purpose if care is taken not to damage the connector. Covers may be pressed onto block 156 in a separate operation, to cover the wire terminations thereon.

Instead of first securing the assembly 6 to the base plate 8 with the comb 34 uppermost, it is preferred first to apply stuffer fingers to the comb 36 and then to the comb 34.

In practice each comb will have double the number of ribs that are shown, and will thus receive double the number of wires. The number of the ribs shown has been limited in the interest of clarifying the drawings.

I claim:

1. A kit of parts for an assembly for use in bench mounting a tool comprising an elongate body and a pair of juxtaposed wiring combs connected to the tool body and extending longitudinally thereof, each comb defining a row of wire receiving slots which extend transversely of the length of the tool body, the kit of parts comprising;

a tool mount having a receptacle for one end of the tool body, means for securing said one end in the receptacle and a support leg depending from the receptacle and defining first pivotal connection means;

a bench stand having a base for mounting on a top surface of a work table, and means for receiving said support leg for limited pivotal movement about a horizontal axis; and a clamp having second pivotal connection means, said first and second pivotal connection means comprising a pivot engagable in a bearing pivotally to connect said support leg to the bench stand for said limited pivotable movement of said support leg, said clamp having clamp means spaced from said second pivotal connection means, for engaging against the underside of the work table to press said pivot against the bench stand to clamp it against the top surface of the work table.

2. A kit of parts as recited in claim 1, wherein the first pivotal connection means comprises a socket defined by the support leg of the tool mount, the second pivotal connection means being a clamp post projecting from the clamp for reception in the socket and for engaging against the bench stand under the action of said clamping means.

3. A kit of parts as recited in claim 1, wherein the first pivotal connection means is a through hole defined by the support leg of the tool mount, the second pivotal connection means being a clamp post projecting from the clamp for insertion through said hole from one side of the support leg so as to project from the opposite side thereof, said clamp post being engageable with the bench stand on both sides of the support leg.

4. A kit of parts as recited in claim 3, wherein the clamp comprises an elongate body, the clamp post projecting from one end of the clamp body normally thereof, a flange projecting from the opposite end of the clamp body receiving a clamping screw for engaging the underside of the work table to urge the clamp post against the bench stand.

5. A kit of parts as recited in claim 4, wherein the flange is resiliently deformable in a direction away from the clamp post.

6. A kit of parts as recited in claim 3, wherein the bench stand has opposite side walls upstanding from the base and defining a channel for receiving the support leg of the tool mount, each side wall having a notch therein for receiving the clamp post.

7. A kit of parts as recited in claim 6, wherein the receptacle of the tool mount has a portion projecting laterally from the support leg, for engaging a side wall of the bench stand in order to limit the pivotal movement of the tool mount.

8. A kit of parts as recited in claim 1, wherein the receptacle of the tool mount comprises a clevis having a flat elongate base extending transversely of the support leg of the tool mount and projecting laterally therefrom, an arm upstanding from each end of the base, a thumb screw extending through a tapped, through opening in one of the arms, the opening extending parallel to the base, the support leg defining a through hole at a position remote from the receptacle for receiving a clamp post on the clamp, said hole extending parallel to said opening.

9. A kit of parts as recited in claim 8, wherein the end of the support leg remote from the receptacle is rounded about the axis of the hole.

10. An assembly for use in bench mounting a tool comprising an elongate tool body and a pair of juxtaposed wiring combs connected to the tool body and extending longitudinally thereof, each comb defining a row of wire receiving slots which extend transversely of the length of the tool body, the assembly comprising;

a tool mount having a receptacle for one end of the tool body, means for securing said one end in the receptacle, a support leg depending from the receptacle and defining a hole extending transversely of the support leg and therethrough, at a position remote from the receptacle, and stop means on the tool mount;

a clamp body having at one end a clamp post extending through the hole in the support leg and clamping means at the other end of the clamp body; and a bench stand having a base mounted on the top surface of a work table, opposite walls upstanding from the base and receiving the support leg between them, said walls having means therein for receiving the clamp post, the clamping means of the clamp body engaging the underside of the work table and thereby urging the bench stand against the top surface of the work table, the tool mount being rockable about the clamp post to an extent limited by the engagement of said stop means against the bench stand.

11. An assembly as recited in claim 10, wherein the tool mount is rockable by approximately 45° on either side of the vertical.

12. An assembly as recited in claim 10, wherein the said means for receiving the clamp post comprise opposed notches opening into free edges of said walls remote from the base of the bench stand.

13. An assembly as recited in claim 10, wherein said clamp body has a flange projecting from said other end of the clamp body parallel to the clamp post and receiving a clamping screw having at one end thereof a head engaging the underside of the work table and at the other end thereof a handle for tightening said head against the underside of the work table.

14. An assembly as recited in claim 10, wherein the receptacle of the tool mount comprises a clevis, part of which projects laterally of the support leg of the tool mount and constitutes the stop means thereof.

15. An assembly as recited in claim 10, wherein the receptacle of the tool mount comprises a clevis having a flat elongate base extending transversely of the support leg of the tool mount and projecting laterally therefrom, an arm upstanding from each end of the base, a thumb screw extending through a tapped opening in one of the arms, which arm is remote from the clamp body.

16. An assembly as recited in claim 10, wherein the support leg of the tool mount has a rounded free end surface remote from the receptacle and positioned proximate to the base of the bench stand and extending about the axis of the hole in the support leg.

17. A kit of parts for an assembly for bench mounting a tool comprising an elongate tool body and a pair of juxtaposed wiring combs connected to the tool body and extending longitudinally thereof, each comb defining a row of wire receiving slots which extend transversely of the length of the tool body, the kit of parts comprising;

a tool mount having a receptacle for one end of the tool body, means for securing said one end in the receptacle and a support leg depending from the receptacle and defining first pivotal connection means;

a bench stand having a base for mounting on a top surface of a work table, and means for receiving said support leg for limited pivotal movement about a horizontal axis; and a clamp having second pivotal connection means interengageable with said first pivotal connection means pivotally to connect said support leg to said clamp for pivotal movement of said tool mount about said horizontal axis, and clamp means for engaging against the underside of the work table to clamp the bench stand against the top surface of the work table, wherein the first pivotal connection means comprises a socket defined by the support leg of the tool mount, the second pivotal connection means being a clamp post projecting from the clamp for reception in the socket and for engaging against the bench stand under the action of said clamping means.

18. An assembly for use in bench mounting a tool comprising an elongate body and a pair of juxtaposed wiring combs connected to the tool body and extending longitudinally thereof, each comb defining a row of wire receiving slots which extend transversely of the length of the tool body, the assembly comprising;

a tool mount having a receptacle for one end of the tool body, means for securing said one end in the receptacle, a support leg depending from the receptacle and defining a hole extending transversely of the support leg and therethrough, at a position remote from the receptacle, and stop means on the tool mount;

a clamp body having at one end first pivotal connection means cooperating with second pivotal connection means of the support leg, and clamping means at the other end of the clamp body;

a clamp body having at one end a clamp post extending through the hole in the support leg and clamping means at the other end of the clamp body; and a bench stand having a base mounted on the top surface of a work table, opposite walls upstanding from the base and receiving the support leg between them, said walls having means therein for receiving the clamp post, the clamping means of the clamp body engaging the underside of the work table and thereby urging a pivot of said pivotal connection means against the bench stand thereby to urge the bench stand against the top surface of the work table, the tool mount being rockable about said pivot to an extent limited by the engagement of said stop means against the bench stand.

* * * * *